US005692342A

United States Patent [19]

Devlin, Jr.

[11] Patent Number: 5,692,342

[45] Date of Patent: Dec. 2, 1997

[54] OPEN BUT SECURE TRAVEL CENTER KIOSK

[76] Inventor: Catherine F. Devlin, Jr., 7 Park Dr., Mt. Kisco, N.Y. 10549

[21] Appl. No.: 740,997

[22] Filed: Nov. 5, 1996

[51] Int. Cl.[6] ..... A47F 10/00; E04H 1/12

[52] U.S. Cl. ..... 52/36.1; 52/36.2; 52/79.1; 52/79.4; D6/470; D6/481

[58] Field of Search ..... 52/36.1, 36.2, 52/79.1, 79.4, 79.9, 79.12, 79.13; D6/470, 481, 423; D25/16

[56] References Cited

U.S. PATENT DOCUMENTS

| | | | |
|---|---|---|---|
| D. 121,494 | 7/1940 | Mann | D25/16 X |
| D. 158,921 | 6/1950 | Wynn | D6/481 X |
| D. 197,766 | 3/1964 | Roxburgh | D25/16 X |
| D. 204,339 | 4/1966 | Audubon | D6/470 |
| D. 241,735 | 10/1976 | Goetz | D6/481 X |
| D. 244,073 | 4/1977 | Urbaniec et al. | D6/481 X |
| D. 260,587 | 9/1981 | Perlmutter . | |
| D. 260,709 | 9/1981 | Perlmutter . | |
| D. 262,926 | 2/1982 | Woolford . | |
| D. 265,617 | 8/1982 | Saurage, III et al. | D6/481 |
| D. 275,893 | 10/1984 | Duggar . | |
| D. 293,747 | 1/1988 | Metzdorf | D6/481 X |
| D. 299,891 | 2/1989 | Belszek | D25/16 X |
| D. 310,607 | 9/1990 | Penna . | |
| D. 313,077 | 12/1990 | Minarro . | |
| D. 358,661 | 5/1995 | Chinnis et al. | D25/16 |
| 959,230 | 5/1910 | Kurz | 52/36.2 |
| 2,867,853 | 1/1959 | Lindgren | 52/36.2 |
| 4,087,144 | 5/1978 | Wax . | |
| 4,236,359 | 12/1980 | Woolford . | |
| 4,471,586 | 9/1984 | Shuch et al. | 52/36.2 |
| 4,571,898 | 2/1986 | Le Cacheux et al. . | |
| 4,702,534 | 10/1987 | Witt et al. | D6/470 X |
| 4,704,827 | 11/1987 | Murphy et al. | D25/16 X |
| 4,755,009 | 7/1988 | Price et al. | D6/422 X |
| 5,321,579 | 6/1994 | Brown et al. . | |
| 5,428,928 | 7/1995 | Hellwig et al. . | |

FOREIGN PATENT DOCUMENTS

| | | | |
|---|---|---|---|
| 2627215 | 8/1989 | France | 52/79.1 |

*Primary Examiner*—Carl D. Friedman
*Assistant Examiner*—Laura A. Saladino
*Attorney, Agent, or Firm*—Steven Horowitz

[57] ABSTRACT

An open but secure kiosk, anchored in the ground, for a full service travel center in an indoor commercial public area is, in one embodiment, substantially rectangular with a small square area removed from each corner and has vertical corner beams, an upper wall portion defined by at least two parallel double upper cross-beams running along the entire upper perimeter of the kiosk, a lower wall portion along the entire lower perimeter of the kiosk directly below the upper wall portion constructed of continuous solid block roughly three feet in height and including the upright side wall of customer counters that form the two longer sides of the kiosk. There are also ceiling cross-beams. Movable grates above the counters close downward and seal the long side walls and there are bright signs at the top of the long walls. The working area is enclosed by the shorter walls and the inside of the main counters, one of which has an entrance section and both of which may contain on their surface transparent openings to view computer screens situated below. Fixed seats are provided for serving customers outside customer counters. The two parallel shorter walls are transparent glass or plastic, provide for bright signs at their tops and have at a lower portion interior side counters for displaying items. At the corners, the cross-beams have video monitors attached thereto. The ceiling, inaccessible from higher floors, has an optional transparent cover.

23 Claims, 7 Drawing Sheets

OPEN BUT SECURE TRAVEL CENTER KIOSK

FIELD OF THE INVENTION

The present invention relates to kiosks in public areas and, in particular, to public area kiosks used for full service travel agencies or other service businesses that maintain valuables, such as financial service businesses.

BACKGROUND OF THE INVENTION

Full service travel agencies are actually a kind of financial services company since they maintain airline tickets, valuable negotiable documents that must be kept securely in order to meet international and domestic airline regulations governing the printing and secure maintenance of such tickets (imposed by such organizations as the IATA and the ARC) both during business hours and during the time period when the office is closed for business. At the same time it can be appreciated that unlike a bank, a full service travel agency caters to people seeking vacations and should therefore convey a sense of excitement, adventure and fun. Finally, as in any service business whose clientele can be almost anyone, the travel center should be easily accessible to as many people as possible and should be exposed to as many potential customers as possible.

To date, the standard travel center or full service travel agency has been located in a traditional office staffed by individuals seated behind desks arranged in an open area of an indoor office. This arrangement has the advantage of maintaining the security aspect of the business in relation to the airline tickets, which are negotiable documents. The disadvantage of the prior art standard indoor office for use as a travel center, however, is that it fails to sufficiently convey the adventure and excitement of travel because it itself is an indoor office not designed for the comfort and convenience of customers and that it is not exposed to as many potential customers as possible because it is indoors.

On the other hand, putting an ordinary kiosk in an open public area would not be sufficiently secure and not provide a sufficiently attractive setting in which to cater to people's sense of adventure, excitement and fun.

There is in the prior art a proposal for a secure kiosk to be used in open public areas. U.S. Pat. No. 4,236,359 to Woolford discloses a self securing merchandising kiosk made out of a base shell, display cabinets and a canopy that can be lowered to mate with the counter top and seal the interior of the kiosk against vandalism. The Woolford kiosk is designed primarily to display merchandise and as such the lower portion of the kiosk disclosed in Woolford is taken up by display cabinets that display merchandise. In addition, the main working area of the Woolford kiosk is not visible to outsiders and especially not to outsiders looking down on it from a second floor of a mall or lobby. This kind of a kiosk would not provide a large and visible full service travel center and certainly not one that can convey a sense of excitement and adventure and comfort for the customer. In addition, although the Woolford kiosk has securing means, none of the base unit of the kiosk is anchored to the floor and it is therefore presumed that, albeit with some difficulty, the kiosk can be carried away by vandals. Finally, the Woolford kiosk is designed primarily to be manned by one salesperson and it cannot be a full service travel center that meets the IATA and ARC regulations.

Other kiosk shapes have been proposed such as those described in U.S. Pat. Nos. Des. 260,587, Des. 310,607 and Des. 313,077 In addition, U.S. Pat. No. 4,571,898 to Le Cacheux et al. discloses a newspaper or other sales kiosk providing protection of the products being sold while at the same time maintaining an attractive appearance. None of the prior art kiosks addresses all the above mentioned needs of a full service travel center kiosk, nor would they meet the international and domestic airline regulations.

In particular, there is a need for an open and exposed yet secure kiosk usable for a financial services business such as a full service travel center and one whose physical structure permits it to convey to passersby the sense of adventure and excitement of travel. In particular, there is a need for such kiosks in large enclosed public commercial areas such as shopping malls, airline terminals, hotel lobbies and convention centers where the outer portion of the kiosk as well as its inner working area can be exposed to tremendous traffic by potential customers and at the same time be secure.

SUMMARY OF THE INVENTION

The present invention meets the above needs by providing an open but secure kiosk for a full service travel center or other financial services business which can be located in an indoor commercial public area such as a shopping mall, airport terminal or hotel lobby. Other service businesses having valuables can also use the structure of the kiosk of the present invention. In one embodiment, looked at from above in a top plan view, the kiosk of the present invention is shaped like a dodecagon, a twelve sided planar figure, but not one of equal sides—rather it is shaped like a rectangular dodecagon, i.e. a rectangle having a small square area removed from each of its corners (referred to sometimes herein as "substantially rectangular"). In the main embodiment, the kiosk structure is defined primarily by vertical beams at its corners ("corner beams"), an upper wall portion defined by at least two parallel double upper cross-beams running along the entire upper perimeter of the kiosk, a lower wall portion running all along the entire lower perimeter of the kiosk directly below the upper wall portion constructed of a continuous solid block roughly three feet in height and including the upright side wall of customer counters that form the two longer sides of the substantially rectangular kiosk. There is a space between the upper wall portion and the lower wall portion for visibility of the kiosk interior working area (and sides of the kiosk other than the side you are looking through). There are also ceiling cross-beams. Movable grates above the counters close downward and seal the long side walls. The middle of the tops of the long side walls have bright signs. The working area is enclosed by the shorter walls and the inside of the main counters, one of which has an entrance section. Both customer counters may contain at points on their surface transparent glass or plastic surface portions through which the worker in the working area can view below-counter computers showing information on their screens. There are fixed stools for customers to be served at the outside of the counters. The two parallel shorter walls are transparent glass or plastic and provide for bright signs at their tops. Inside the shorter walls at a lower portion are interior counters or "side counters" for holding display items. State of the art office equipment, including computers, for the operation of a full service travel center can be maintained under the side counters. At the four cut-out corners, the cross-beams have means of attachment for video monitors. The kiosk is anchored into the ground. The ceiling, which is inaccessible from higher floors, has an optional transparent cover.

OBJECTS AND ADVANTAGES

The following important objects and advantages of the present invention are:

(a) to provide a kiosk usable for a full service travel business located in a large commercial enclosed area such as shopping malls, airline terminals, hotel lobbies and convention centers, (b) to provide such a kiosk that is secure and whose long side walls close to seal the counters and whose short walls are closed, (c) to provide such a kiosk that is visible to passersby and nearby potential customers who are on the same floor as the kiosk as well as those on higher floors, (d) to provide such a kiosk that is composed of walls that are largely transparent or open and which may contain interesting displays behind them, (e) to provide such a kiosk that has parallel customer counters along its long side walls and interior counters along its short side walls that enclose the inner working area and where outside the customer counters are fixed seats for customers, (f) to provide such a kiosk where the working area contains high tech computer and office equipment such as reservation computers, ticket printers, invoice printers, computer modems and telephones and literature that is not visible when the office is closed and that meets the IATA and ARC regulations, (f) to provide such a kiosk wherein video monitors for displaying adventurous and interesting travel destinations are affixed to the upper portions of corners or edges of the kiosk.

(g) to provide such a kiosk wherein a portion of the top surface of one or more customer counters contains a transparent glass opening through which to view a below-counter computer screen that can be used for making travel reservations and providing other information conveniently, and (h) to provide such a kiosk that is anchored to the floor.

Reference will now be made to drawings illustrating the present invention so that a better understanding of the invention can be gleaned.

DETAILED DESCRIPTION OF THE DRAWINGS

Figure 1:
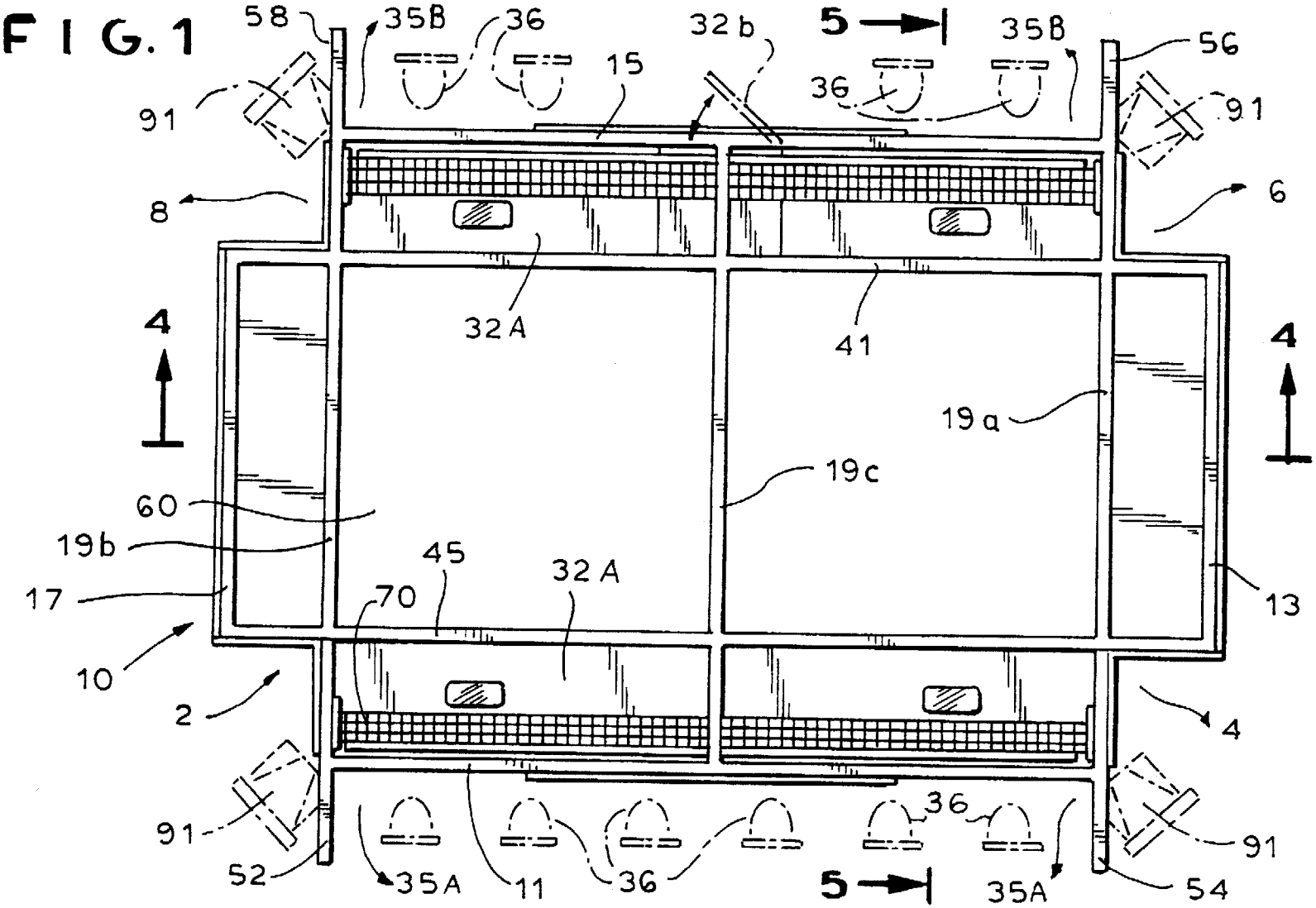
FIG. 1 is a top plan view of the kiosk of the present invention.

As seen in FIGS. 1–7, the kiosk 10 is defined by four metal corner beams 12, 14, 16, 18 and has four walls or sides 11, 13, 15, 17 connecting corner beams 12, 14, 16, 18. The walls or sides 11, 13, 15, 17 contain an upper wall portion 20 defining a plane and made of at least two parallel double upper cross-beams 22, 24 running along the entire upper perimeter of kiosk 10. Optionally included in the upper wall portion 20 for additional support are support beams 23 placed at equal intervals and perpendicularly spanning the distance between the two parallel double upper cross-beams 22, 24. Smaller parallel upper cross-beams 26, 28 may also form part of the upper wall portion 20 running along the perimeter of kiosk 10. In addition, there is a lower wall portion 30 of kiosk 10 running all along the entire lower perimeter of kiosk 10 directly below upper wall portion 20. Lower wall portion 30 is constructed of a continuous solid block. The continuous solid block 30 is roughly three feet in height and forms the upright side wall 30*a* of customer counters 32 along the two long sides 11, 15 of kiosk 10 (sometimes called "long walls") and the upright side wall 30*a* of interior or side counters 33 along the two short sides 13, 17 of kiosk 10. Accordingly, there is a significant space between the upper wall portion 20 and the lower wall portion 30 that allows visibility of the working area 60 of kiosk 10 by people who are prospective customers and who are walking around in the enclosed public commercial area and may allow visibility of the other side of kiosk 10. The block 30 forming the lower wall portion 30 may be made of sheetrock or any suitable material. All cross beams and corner beams are made of sufficiently strong metallic substances.

Besides rectangular, kiosk 10 can really be any shape, preferably polygonal, suitable for the available space that it is located in and can certainly be square. If square or of another quadrilateral shape, kiosk 10 would need not have long and short sides but would have two opposite customer service sides ("customer sides") (instead of long sides) and two opposite display sides (instead of short sides). Also, it is possible that for some quadrilateral shapes of kiosk 10 that the ceiling beams may not be exactly but only substantially parallel and/or perpendicular to the customer and display sides. Typically, kiosk 10 should have at least two customer sides 11, 15 and at least two display sides 13, 17 and would be substantially polygonal (having corners where two sides meet). Theoretically, however, kiosk 10 could even be entirely circular and instead of customer sides and display sides, there would simply be customer segments of the circle and display segments of the circle. If circular, instead of vertical corner beams there would simply be vertical beams at defined intervals intersecting a display segment and a customer segment. Instead of transparent vertical planar side wall panels, the display segments would have transparent vertical arcuate or curved wall panels. The kiosk 10 depicted in FIGS. 1–7 depicted herein happens to be substantially rectangular. Since kiosk 10 is, in the embodiment depicted in the FIGS. 1–7, a rectangle, the four walls 11, 13, 15, 17 define two parallel long sides 11, 15 and two shorter sides 13, 17. Each of the two shorter sides 13, 17 consists of five pieces. For example, shorter side wall 13 consists of the main side wall section 13*a* and the four corner pieces 13*b*, 13*c*, 13*d*, 13*e*, that is two at each of the two corners that side wall 13 abuts. Similarly, shorter side wall 17 consists of the main side wall section 17*a* and the four corner pieces 17*b*, 17*c*, 17*d*, 17*e*, that is two at each of the two corners that side wall 17 abuts.

In addition, defining the ceiling 80 of the structure of kiosk 10, connecting the top of the edge where corner pieces 13*b* and 13*c* meet to the top of the edge where corner pieces 13*d* and 13*e* meet is a single horizontal upper cross-beam 19*a* perpendicular to the long walls 11, 15, and connecting the top of the edge where corner pieces 17*b* and 17*c* meet to the top of the edge where corner pieces 17*d* and 17*e* meet is a single horizontal upper cross-beam 19*b* perpendicular to the long walls 11, 15. Parallel to horizontal cross-beams 19*a*, 19*b* is a single central horizontal cross-beam 19*c* which connects the approximate midpoint of long walls 11 and 15 to one another and provides additional stability.

Figure 2:
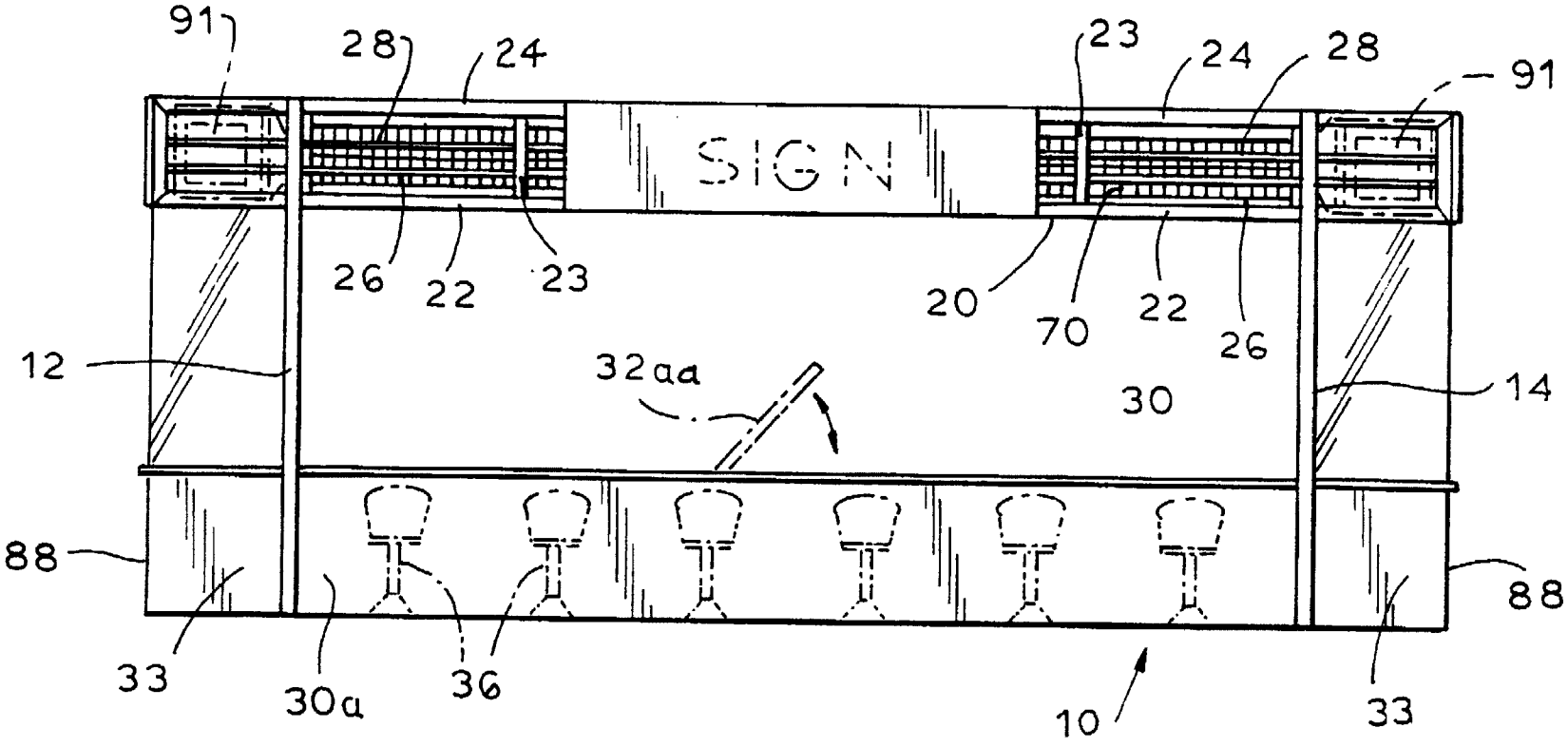
FIG. 2 is a side elevation view of the kiosk of the present invention with the grates up.
Figure 3:
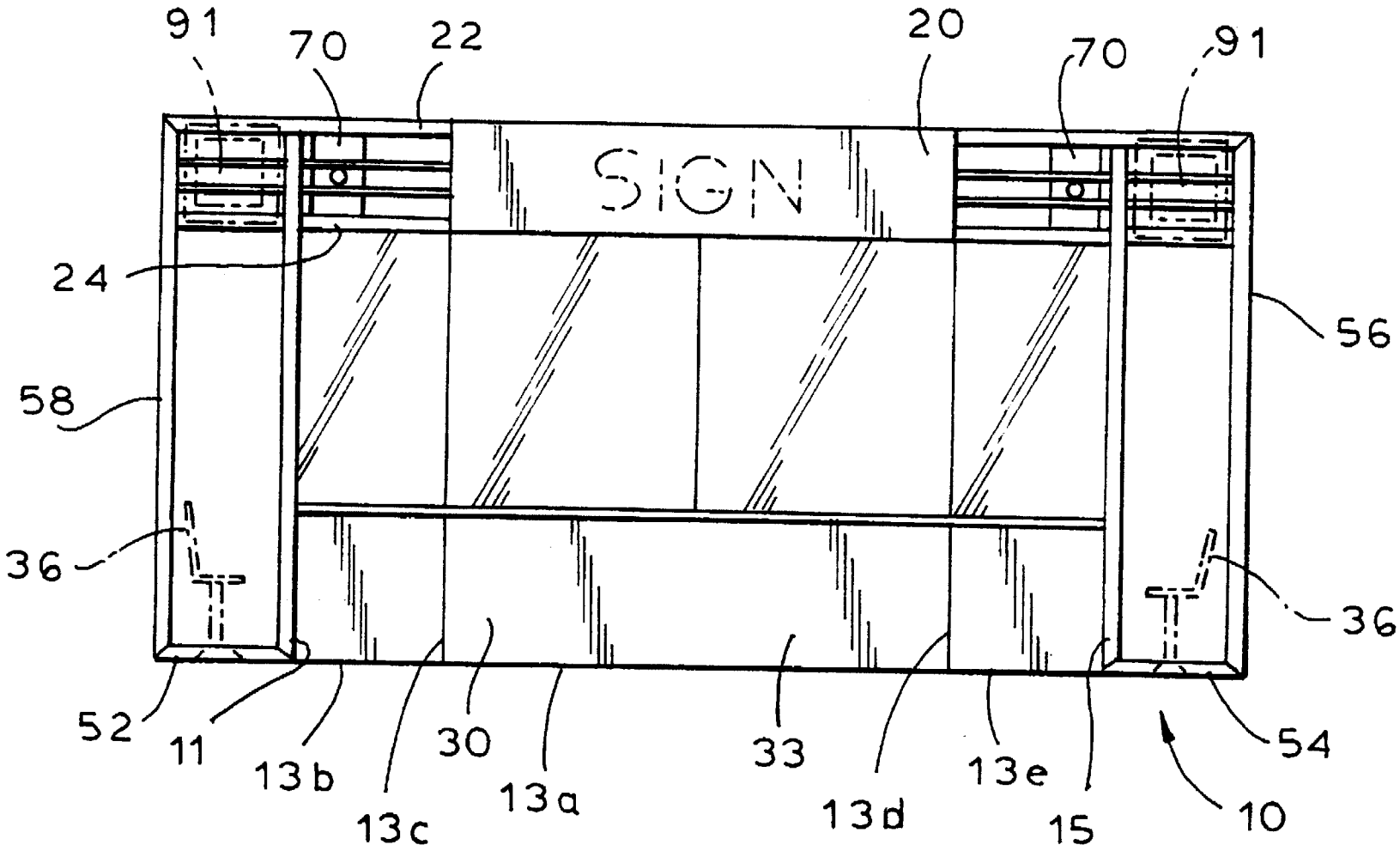
FIG. 3 is an end elevation view of the kiosk of the present invention.
Figure 4:
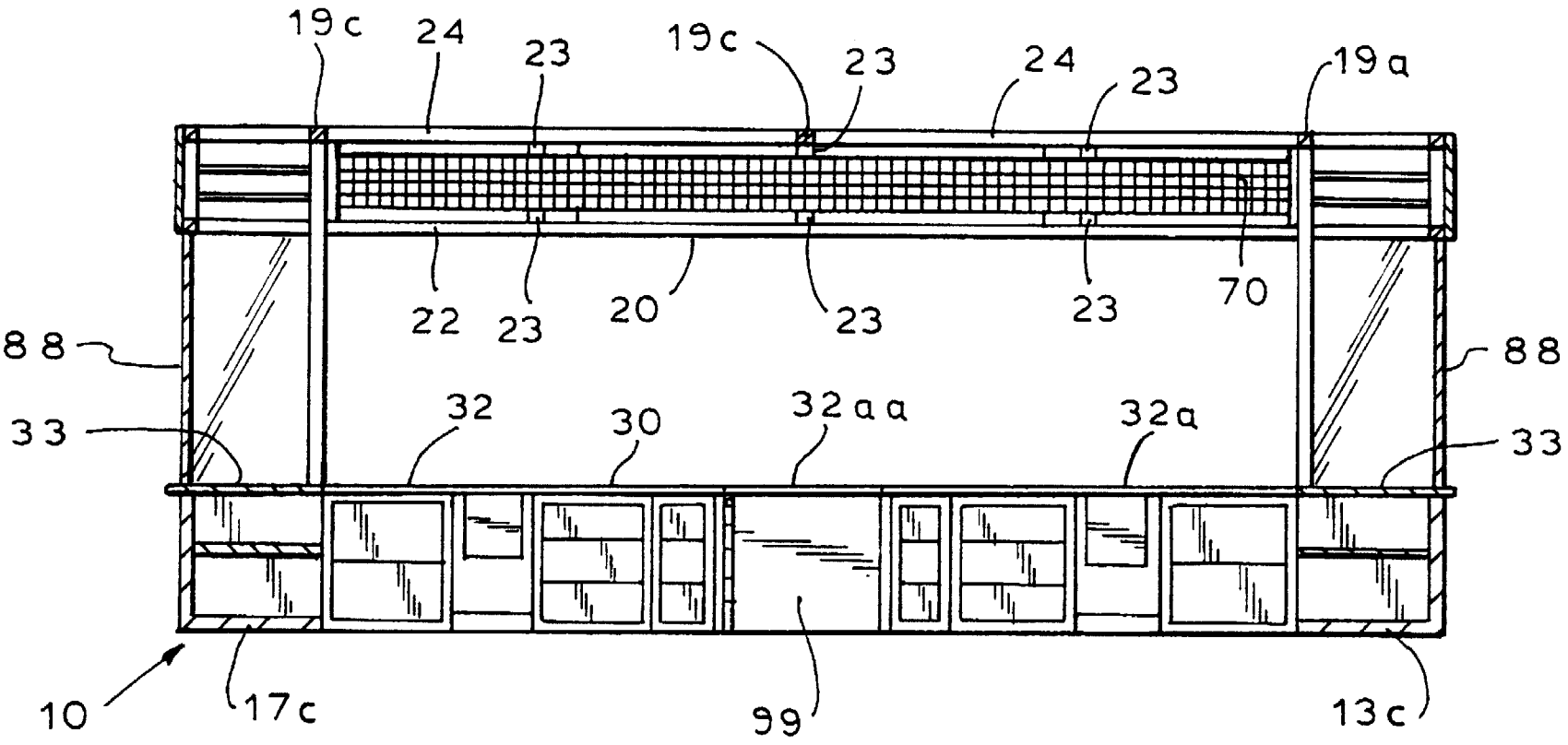
FIG. 4 is a longitudinal vertical section of the kiosk of the present invention taken along line 4—4 of FIG. 1.
Figure 5:
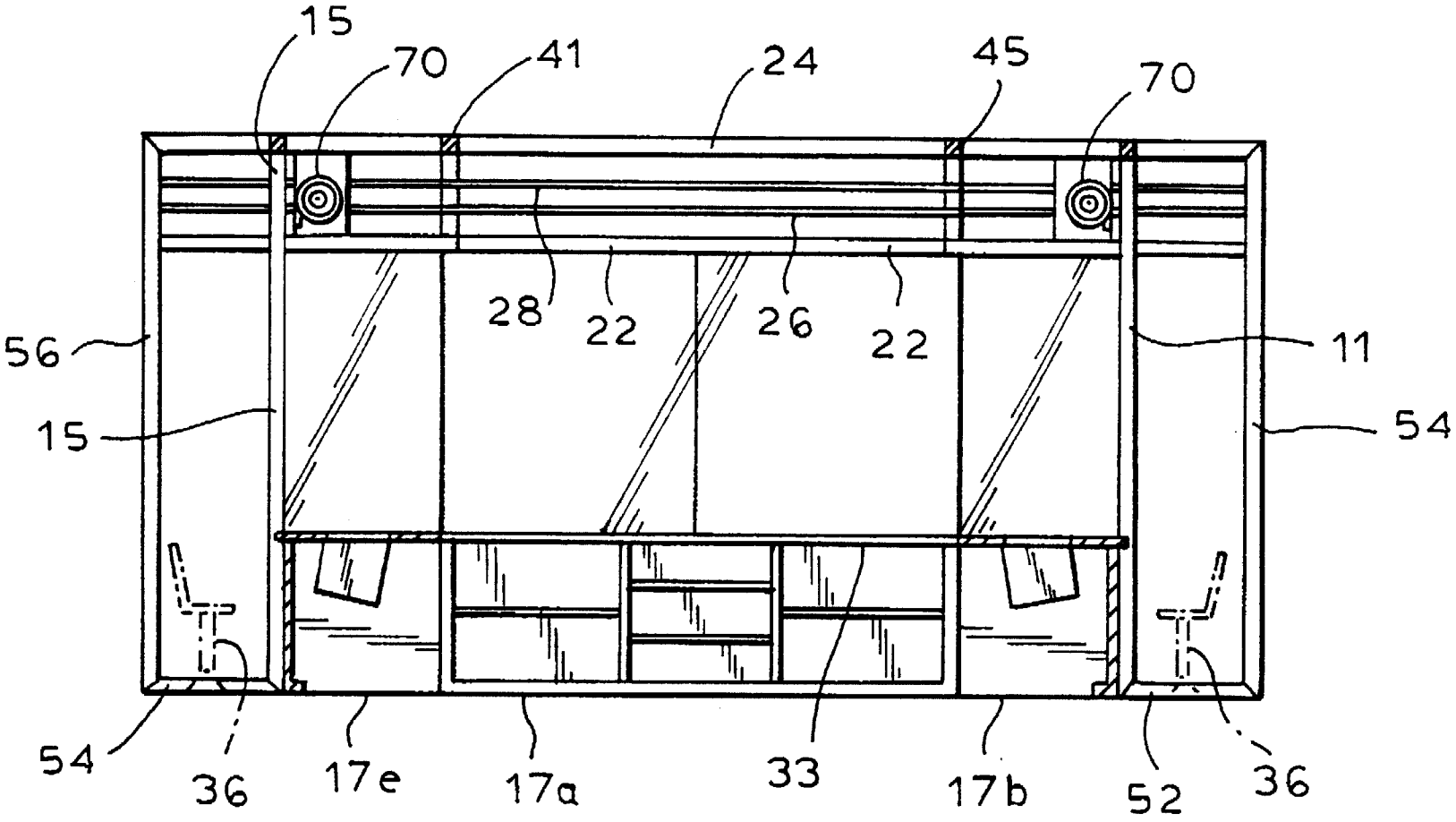
FIG. 5 is transverse vertical section view of the kiosk of the present invention taken along line 5—5 of FIG. 1.
Figure 6:
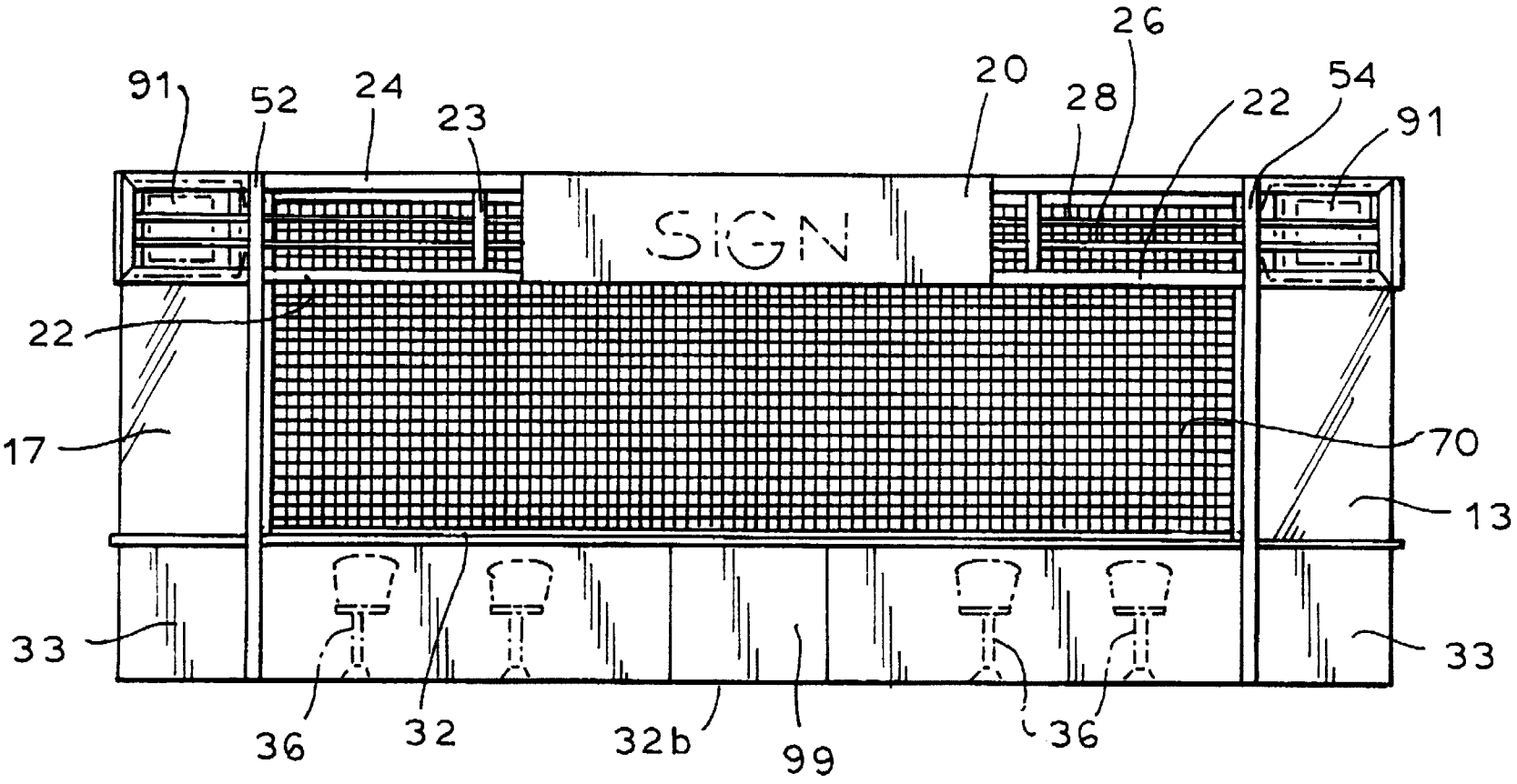
FIG. 6 is a side elevation view of the kiosk of the present invention with the grates down.
Figure 7:
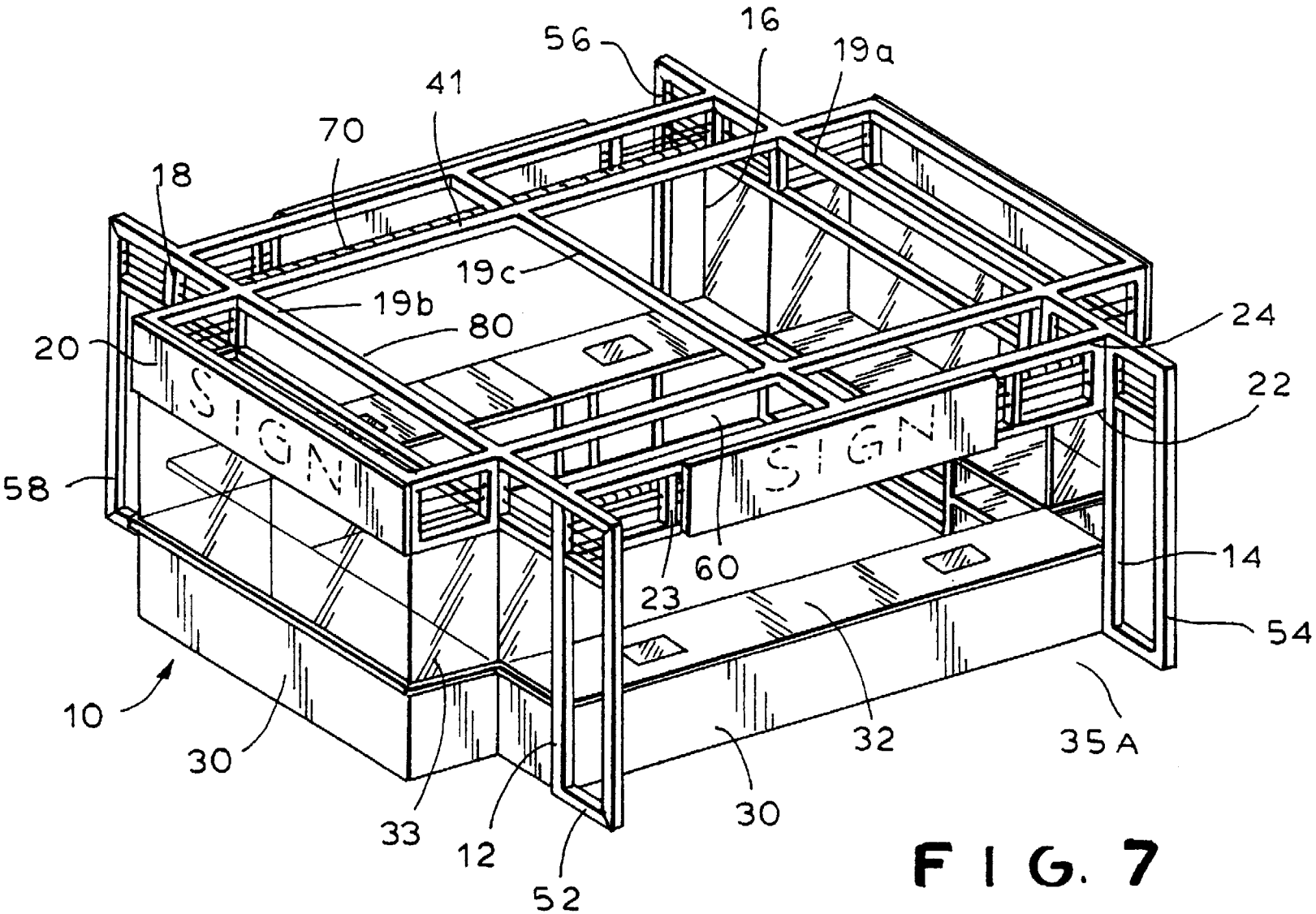
FIG. 7 is a perspective view of the kiosk of the present invention.

Furthermore, parallel to the long walls 11, 15 are, respectively, single horizontal upper cross-beams 41, 45 which define an inner rectangle on the ceiling 80 together with cross-beams 19*a* and 19*b*. Finally, as seen in FIG. 2, the double upper cross beams 22, 24 of upper wall portion 20 are extended outward at four locations to form partition wall panels 52, 54, 56, 58 beyond the perimeter of the outer rectangle formed by kiosk 10 in order to define an additional semi-enclosed rectangular areas 35*a*, 35*b* used by customers seeking service and preferably contain fixed seats 36, such as swiveling stools or even extensions from counters 32, along customer counters 32. Semi-enclosed areas 35*a*, 35*b* need not be precisely rectangular and can in certain embodiments be trapezoidal if partition wall panels 52, 54, 56, 58 are not perpendicular to the customer counters 32. It is even conceivable for the partition wall panels 52, 54, 56, 58 to be curved (in a top plan view looking down at them) in certain embodiments but there would still be defined semi-enclosed areas 35*a*, 35*b*.

There is no corresponding lower wall portion 30 having a solid block for the four partition wall panels 52, 54, 56, 58. The number of fixed seats 36 is not essential to the present invention and it can be imagined that in certain embodiments there are fewer seats 36, or even no such seats if the means for servicing the customers at the customer counters 32 does not entail the use of seating the customers. Again, although not essential to the present invention, it is also plausible that there would be more seats 36 along the customer counter 32 not containing an entrance to working area 60 than along the customer counter 32 providing entrance to the working area 60.

As seen in FIG. 1, the kiosk 10 of the present invention is substantially dodecagonal, there are essentially twelve sides to it with the exception of the partition wall panels 52, 54, 56, 58, although not equal sides since it is substantially rectangular. Looking down at the kiosk 10, the kiosk can be said to resemble a rectangle with a small square cut out portion removed from each corner therethrough. The outlines of such a rectangle may be imagined by reference to the dashed lines at each of the corners 2, 4, 6, 8 of the rectangle formed by the kiosk 10. The exception to the form of a dodecagonal cross-section are the partition wall panels 52, 54, 56, 58, at long sides 11, 15 of the kiosk 10 which define semi-enclosed rectangular areas 35A, 35B for fixed seats 36 to be used by customers. Partition wall panels 52, 54, 56, 58 contain a transparent glass or strong plastic and run from the floor to the top of kiosk 10 without any block 30 forming a lower wall portion 30.

Video monitors 91 for conveying the adventure and excitement of travel, and controlled by a video machine inside working area 60, are mounted at the top of corner beams 12, 14, 16, 18 by any suitable means such as a bracket capable of holding the back of the video monitor 91 being attached to the upper portion of corner beams 12, 14, 16, 18. In certain embodiments, this invention contemplates setting up the monitors 91 so that they may be lowered and be accessible to individuals outside the kiosk 10 even after business hours, for example, by extending the bracket holding the monitors 91 and forming a track for movement of the monitors 91 thereon. In this way, or even without this feature, monitors 91 can be programmed to go off at a time later than the closing up of kiosk 10 at the end of the business day. This is especially appropriate for areas providing the setting for kiosk 10 such as hotel lobbies or airline terminals where customer traffic exists beyond normal business hours. Similarly, it is also contemplated by the present invention that each monitor 91 can contain as part of it or alongside it a ticket dispensing machine for ticketing and reservations that would be interactive and accessible to users outside the kiosk 10 in unattended areas of kiosk 10. Accordingly, it is clearly contemplated by this invention that kiosk 10 be designed for the automated computerized world of the future including making use of the Internet, virtual reality travel kiosks and 24 hour ticket delivery systems in unattended areas of the kiosk 10.

Kiosk 10 is affixed to the floor by being anchored to the floor beneath corner beams 12, 14, 16, 17 or at any other suitable location.

The double upper cross-beams of upper wall portion 20 are ideally suited for signs depicting the name of the travel center located in the middle of any of the side walls 11, 13, 15, 17.

The interior working area 60 of kiosk 10 is defined by customer counters 32 along long walls 11, 15 and interior counters 33 along short walls 13, 17. As seen in FIGS. 1, 2, an example of an entrance to working area 60 is provided whereby a section 99 is removed from one of the customer counters 32, preferably near the midpoint of customer counters 32, so that a part 32*aa* of the counter top 32*a* can be lifted upward on one side to an open position. In addition, a door 32*b* opens laterally in the upright side wall 30*a* below the part 32*aa* of the counter top 32*a* thus providing access to the opening section 99 of counter 32. The present invention is not limited to this exact type of entrance and other arrangements for an entrance may be imagined.

One (or more) portions of the counter tops 32*a* of customer counters 32 features a built-in transparent glass or plastic window area through which workers can see below-counter computer screens such that workers have instant access to travel information and reservations and such that the computers are not visible to the customers or to anyone outside kiosk 10 after office hours. Although not essential to the present invention, there may be an anti-glare shield above the counter top 32*a* for looking through the glass window at the computer screen below the counter 32. In addition, working area 60 contains needed office equipment and shelf space right behind the customer counter for workers to use. In other words, built in to the inner part of counters 32 visible to workers in the working area are spaces for travel literature, supplies and office equipment and the safe-keeping of documents. Similarly, state of the art office equipment, including computers, ticket printers, safes, files, invoice printers for the operation of a full service travel center can be maintained under the side counters 33 or the customer counters 32. Any chairs needed for workers may be located in the working area 60. Working area 60 is designed to allow a full service travel center to operate. This includes actual printing of tickets and boarding passes on site. An entire full service travel office, exposed to all to see is thus situated right in the shopping mall or airport terminal or hotel lobby. Attractive displays may be placed behind the transparent glass of short walls 13, 17 and adjacent to the corner beams 12, 14, 16, 18.

Although kiosk 10 can be a full service travel center, its physical structure also permits it to be a travel center that is not full service, and one that is computer linked to another full service office where the actual ticket printing can take place. Security for kiosk 10 is provided by closing the area from counter tops 32*a* to the bottom of the double upper cross-beams 22, 24 along long walls 11 and 15 by means of movable grates 70 that roll down and up. When kiosk is in use, grate 70*a* in open or "up" position is wedged between the upper wall portion 20 of long wall 11 and horizontal single cross-beam 41 and similarly grate 70*b* is wedged between upper wall portion 20 of long wall 15 and single cross-beam 45. In closed position, grates 70*a*, 70*b* roll down to mate with the part of counter tops 32*a* closest to fixed seats 36. This seals the two long walls 11, 15, and in particular seals the space between customer counters 32 and the uppermost part of upper wall portion 20. The use of movable grates 70 are not the only means imaginable for sealing the long walls 11, 15 (or customer sides in a nonrectangular structure or customer segments in a round configuration of the kiosk) but any such means must allow visibility into the working area 60 in a closed position and must be secure and strong. It would certainly be contemplated by the present invention to use movable grates 70 that close laterally instead of moving from the upper wall portion 20 to the lower wall portion 30.

The two short walls 13, 17 are inherently sealed because for each side wall 13, 17, vertical planar side wall panels 88 made of transparent plastic or glass stand just outside of interior counters 33 and seals the space between lower wall portion 30 and upper wall portion 20 along short walls 13, 17 as well as any spaces between the double upper cross-beams 22 and 24 at side walls 13, 17.

The top of kiosk 10 is secured in at least one or two ways. First of all, the kiosk 10 is situated on the ground floor and there is either no higher floor or else there is no access to kiosk 10 from an upper floor of the shopping mall, hotel lobby or airport terminal. For example, the walkway of the second floor of a shopping mall may overlook the kiosk 10 from above but the kiosk 10 is not reachable. In addition, optionally, the kiosk 10 may be covered at its top with a transparent glass or hard plastic affixed to the ceiling 80.

It can be appreciated that kiosk 10 as described by the above drawings is see-through from the sides and from the top except for the lower wall portions, the beams the signs and any interior displays. Accordingly, while secure, everyone in the public commercial area sees its inside. The physical structure of kiosk 10 allows the conduct of a full service travel business or other financial services business in a mall environment thereby generating increased business. It should also be noted that grates 70 in "down" position are not solid blocks but have "crisscrossing" metal wires allowing visibility of the interior of kiosk 10 even when the grates 70 are closed.

It is to be understood that while the apparatus of this invention have been described and illustrated in detail, the above-described embodiments are simply illustrative of the principles of the invention. It is to be understood also that various other modifications and changes may be devised by those skilled in the art which will embody the principles of the invention and fall within the spirit and scope thereof. It is not desired to limit the invention to the exact construction and operation shown and described. The spirit and scope of this invention are limited only by the spirit and scope of the following claims.

What is claimed is:

1. A kiosk for a travel business or other financial services business in an enclosed commercial public area, comprising:

a quadrilateral structure having display sides and customer sides and having vertical corner beams at intersections of the display and customer sides, said display sides being enclosed by transparent vertical planar side wall panels, the structure defined by a planar upper wall portion around a perimeter of the kiosk and a lower wall portion around the perimeter of the kiosk, the upper and lower wall portions having a large space between them through which at least an interior working area is visible, the upper wall portion comprised of at least double parallel upper cross-beams, the lower wall portion made of a solid block which includes upright side walls of two parallel customer counters defining the customer sides of the quadrilateral structure, and which includes upright side walls of two parallel interior counters defining the display sides of the quadrilateral structure, single horizontal cross-beams forming a ceiling, a semi-enclosed area for use by customers seeking service defined by transparent partition wall panels extending outward from the corner beams on opposite sides of the customer counters, sealing means for each of the customer sides whose purpose is to seal the space between the customer counters and an uppermost part of the upper wall portion and which are each located in an up position between a single horizontal cross-beam parallel to a respective one of the customer sides and the upper wall portion of the same customer side, and the interior working area for servicing customers, displaying items and storing information and office equipment.

2. The kiosk of claim 1, wherein the upper wall portion features a display sign identifying the business.

3. The kiosk of claim 1, wherein said customer counters includes counter tops which, at portions of the counter tops, have transparent glass windows through which workers are able to see below-counter computers mounted therein.

4. The kiosk of claim 1, wherein the single horizontal cross-beams forming the ceiling define an interior rectangle and include at least three single horizontal cross-beams substantially perpendicular to the customer sides and two single horizontal cross-beams substantially parallel to the customer sides and where the upper wall portion has perpendicular support beams at equal intervals spanning the distance between the double parallel upper cross-beams.

5. The kiosk of claim 1, wherein video monitors for displaying travel scenes are mounted on the upper wall portion or on the corner beams of the kiosk.

6. The kiosk of claim 1, wherein the semi-enclosed area contains fixed seats and is substantially rectangular and wherein the sealing means comprises movable grates.

7. The kiosk of claim 1, wherein the upper wall portion features a display sign identifying the business, said customer counters include counter tops, which, at portions of the counter tops, have transparent glass windows through which workers are able to see below-counter computers mounted therein, the ceiling includes at least three single horizontal cross-beams substantially perpendicular to the customer sides and two single horizontal cross-beams substantially parallel to the customer sides, the upper wall portion has perpendicular support beams at equal intervals spanning the distance between the double parallel upper cross-beams and video monitors for displaying travel scenes are mounted on the upper wall portion at corners of the structure.

8. A kiosk for a travel business or other financial services business in an enclosed commercial public area, comprising:

a substantially rectangular structure having short sides and long sides and having vertical corner beams at intersections of the short and long sides, said short sides being enclosed by transparent vertical planar side wall panels, the structure defined by a planar upper wall portion around a perimeter of the kiosk and a lower wall portion around the perimeter of the kiosk, the upper and lower wall portions having a large space between them through which at least an interior working area is visible, the upper wall portion comprised of at least double parallel upper cross-beams, the lower wall portion made of a solid block which includes upright side walls of two parallel customer counters defining the long sides of the substantially rectangular structure, and which includes upright side walls of two parallel interior counters defining the short sides of the substantially rectangular structure, single horizontal cross-beams forming a ceiling, a semi-enclosed area for use by customers seeking service defined by transparent partition wall panels extending outward from the corner beams on opposite sides of the customer counters, sealing means for each of the long sides whose purpose is to seal the space between the customer counters and an uppermost part of the upper wall portion and which are each located in an up position between a single horizontal cross-beam parallel to a respective one of the long sides and the upper wall portion of the same long side, and the interior working area for servicing customers, displaying items and storing information and office equipment.

9. The kiosk of claim 8, wherein the upper wall portion features a display sign identifying the business.

10. The kiosk of claim 8, wherein said customer counters include counter tops which, at portions of their counter tops, have transparent glass windows through which workers are able to see below-counter computers mounted therein.

11. The kiosk of claim 8, wherein the single horizontal cross-beams forming the ceiling define an interior rectangle and include at least three single horizontal cross-beams perpendicular to the long sides and two single horizontal cross-beams parallel to the long sides and where the upper wall portion has perpendicular support beams at equal intervals spanning the distance between the double parallel upper cross-beams.

12. The kiosk of claim 8, wherein video monitors for displaying travel scenes are mounted on the upper wall portion or on the corner beams of the kiosk.

13. The kiosk of claim 8, wherein the semi-enclosed area contains fixed seats and is substantially rectangular and wherein the sealing means comprises movable grates.

14. The kiosk of claim 8, wherein the upper wall portion features a display sign identifying the business, said customer counters include counter tops which, at portions of the counter tops, have transparent glass windows through which workers are able to see below-counter computers mounted therein, the ceiling includes at least three single horizontal cross-beams perpendicular to the long sides and two single horizontal cross-beams parallel to the long sides, the upper wall portion has perpendicular support beams at equal intervals spanning the distance between the double parallel upper cross-beams and video monitors for displaying travel scenes are mounted on the upper wall portion at corners of the structure.

15. A kiosk for a full service travel center or other financial services business in an enclosed commercial public area, comprising:

a substantially rectangular structure having short sides and long sides and having vertical corner beams at intersections of the short and long sides, said short sides being enclosed by transparent vertical planar side wall panels, the structure defined by a planar upper wall portion around a perimeter of the kiosk and a lower wall portion around the perimeter of the kiosk, the upper and lower wall portions having a large space between them through which at least an interior working area is visible, the upper wall portion comprised of at least double parallel upper cross-beams, the lower wall portion made of a solid block which includes upright side walls of two parallel customer counters defining the long sides of the substantially rectangular structure, and which includes upright side walls of two parallel interior counters defining the short sides of the substantially rectangular structure, single horizontal cross-beams forming a ceiling, a semi-enclosed rectangular area for use by customers seeking service defined by transparent partition wall panels extending outward from the corner beams on opposite sides of the customer counters, video monitors for displaying travel scenes mounted on the upper wall portion at corners of the structure, sealing means for each of the long sides whose purpose is to seal the space between the customer counters and an uppermost part of the upper wall portion and which are each located in an up position between a single horizontal cross-beam parallel to a respective one of the long sides and the upper wall portion of the same long side, and the interior working area for servicing customers, displaying items and storing information and office equipment.

16. The kiosk of claim 15, wherein the upper wall portion features a display sign identifying the business.

17. The kiosk of claim 15, wherein said customer counters include counter tops which, at portions of the counter tops, have transparent glass windows through which workers are able to see below-counter computers mounted therein.

18. The kiosk of claim 15, wherein the single horizontal cross-beams forming the ceiling define an interior rectangle and include at least three single horizontal cross-beams perpendicular to the long sides and two single horizontal cross-beams parallel to the long sides and where the upper wall portion has perpendicular support beams at equal intervals spanning the distance between the double parallel upper cross-beams.

19. The kiosk of claim 15, wherein the semi-enclosed area contains fixed seats and is substantially rectangular and wherein the sealing means comprises movable grates.

20. The kiosk of claim 15, wherein the double parallel upper cross-beams features a display sign identifying the business, said customer counters include counter tops which, at portions of the counter tops, have transparent glass windows through which workers are able to see below-counter computers mounted therein, the ceiling includes at least three single horizontal cross-beams perpendicular to the long sides and two single horizontal cross-beams parallel to the long sides and, the upper wall portion has perpendicular support beams at equal intervals spanning the distance between the double parallel upper cross-beams.

21. A kiosk for a travel business or other financial services business in an enclosed commercial public area, comprising:

a substantially circular structure having display segments and customer segments and having vertical beams at intersections of the display and customer segments, said display segments being enclosed by transparent vertical curved segment wall panels, the structure defined by a circular upper wall portion around a perimeter of the kiosk and a lower wall portion around the perimeter of the kiosk, the upper and lower wall portions having a large space between them through which one can see at least an interior working area is visible, the upper wall portion comprised of at least double parallel upper cross-beams, the lower wall portion made of a solid block which includes upright segment walls of two separate customer counters defining the customer segments of the substantially circular structure, and which includes upright segment walls of two separate interior counters defining the display segments of the substantially circular structure, single horizontal cross-beams forming a ceiling, a semi-enclosed area defined by transparent partition wall panels extending outward from the vertical beams on opposite sides of the customer counters, sealing means for each of the customer segments whose purpose is to seal the space between the customer counters and an uppermost part of the upper wall portion and which are each located in an up position between a single horizontal cross-beam parallel to a respective one of the customer segments and the upper wall portion of the same customer segment, video monitors for displaying travel scenes mounted on the upper wall portion of the structure, and the interior working area for servicing customers, displaying items and storing information and office equipment.

22. The kiosk of claim 21, wherein the semi-enclosed area contains fixed seats and wherein the sealing means comprises movable grates.

23. The kiosk of claim 21, wherein the double parallel upper cross-beams feature a display sign identifying the business, said customer counters include counter tops which, at portions of the counter tops, have transparent glass windows through which workers are able to see below-counter computers mounted therein, the ceiling includes at least three single horizontal cross-beams perpendicular to the customer segments and two single horizontal cross-beams parallel to the customer segments, and the upper wall portion has perpendicular support beams at equal intervals spanning the distance between the double parallel upper cross-beams.

* * * * *